US006792629B2

(12) United States Patent
Nelson et al.

(10) Patent No.: US 6,792,629 B2
(45) Date of Patent: Sep. 21, 2004

(54) SYSTEM AND TECHNIQUE FOR MOUNTING A FAUCET

(75) Inventors: Alfred C. Nelson, Carmel, IN (US); Derek A. Brown, Avon, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 10/352,559

(22) Filed: Jan. 28, 2003

(65) Prior Publication Data

US 2004/0143900 A1 Jul. 29, 2004

(51) Int. Cl.[7] ..... E03C 1/042
(52) U.S. Cl. ..... 4/695
(58) Field of Search ..... 4/695; 137/315.15, 137/359, 801; 285/209

(56) References Cited

U.S. PATENT DOCUMENTS

| | | | | |
|---|---|---|---|---|
| 3,414,298 A | * | 12/1968 | Butler | 285/209 |
| 3,669,141 A | * | 6/1972 | Schmitt | 137/359 |
| 4,095,494 A | | 6/1978 | Castoe | |
| 4,848,195 A | | 7/1989 | Hockenbery | |
| 4,854,198 A | | 8/1989 | Batten | |
| 5,010,922 A | | 4/1991 | Agresta | |
| 5,073,991 A | | 12/1991 | Marty | |
| 5,214,985 A | | 6/1993 | Rinehart | |
| 5,388,287 A | | 2/1995 | Tischler et al. | |
| 5,425,289 A | | 6/1995 | Iwinski | |
| 5,465,749 A | | 11/1995 | Sauter et al. | |
| 5,542,321 A | | 8/1996 | Fuca | |
| 5,697,268 A | | 12/1997 | Makovsky et al. | |
| 5,819,610 A | | 10/1998 | Brannan | |
| 5,887,496 A | | 3/1999 | Pollard et al. | |
| 5,893,387 A | * | 4/1999 | Paterson et al. | 137/359 |
| 5,996,447 A | | 12/1999 | Bayouth | |
| 6,082,407 A | | 7/2000 | Paterson et al. | |
| 6,138,296 A | | 10/2000 | Baker | |
| 6,301,728 B1 | * | 10/2001 | Pilatowicz et al. | 4/695 |
| 6,334,226 B1 | | 1/2002 | Tokunaga et al. | |
| 6,370,712 B1 | | 4/2002 | Burns et al. | |

FOREIGN PATENT DOCUMENTS

DE 4103955 * 8/1991

* cited by examiner

*Primary Examiner*—Charles E. Phillips
(74) *Attorney, Agent, or Firm*—Woodard Emhardt, Moriarty, McNett & Henry LLP

(57) ABSTRACT

A faucet mounting system includes a trim member to which a faucet hub is attached. The system includes a pair of screws that attach the trim member to a foot member. The foot member is slid into a faucet opening in the deck. From the top of the deck, the screws are used to clamp the deck between the trim member and the foot member. The trim member defines a receptacle with alignment tabs that are used to position the faucet hub in the receptacle. The faucet hub has a mounting shank to which a mounting bracket is attached in order to secure the faucet hub to the deck from the underside of the deck.

19 Claims, 9 Drawing Sheets

SYSTEM AND TECHNIQUE FOR MOUNTING A FAUCET

BACKGROUND OF THE INVENTION

The present invention generally concerns faucets and techniques for installing faucets, and more specifically, but not exclusively, concerns a faucet mounting system that allows the installer to lock the orientation of the faucet from above the sink during installation.

Installation of a faucet can be a rather difficult and arduous process. Typically, faucets are secured to the sink or countertop from below. In one type of faucet design, the faucet has a threaded supply tube that extends below the sink through a faucet opening. From underneath the sink, a nut has to be threaded onto the supply tube in order to secure a mounting bracket to the tube. The nut is then tightened so that the mounting bracket firmly secures the faucet to the sink.

As one should appreciate, the space underneath a sink or countertop is usually rather cramped and poorly lit, thereby making installation troublesome. As a result, it is very difficult to install the faucet as a single-person job. A number of setbacks can occur during installation that can lead to frustration on the part of the installer. For instance, when the installer is tightening the faucet from underneath the sink, the installer can accidentally rotate the faucet out of position such that the faucet is tightened in the wrong orientation. The installer blindly tightens the bracket without seeing the misalignment until after the installer has been extricated from underneath the sink so as to view the result. After the misalignment is discovered, the installer then has to go back underneath the sink in order to loosen the bracket. Next, the installer from above the sink has to reposition the faucet. Once again, the installer has to go underneath the sink in order to tighten the bracket with the hope that the faucet will stay properly aligned during tightening. It should be appreciated that this faucet installation process can be both physically and mentally demanding.

Above the sink or top side faucet mounting systems have been developed in order to alleviate some of the difficulty associated with mounting the faucet from underneath the sink. For example, in one type of top mount design, a pair of tabs are attached to a pair of screws that are secured to a faucet. During insertion of the tabs into the faucet opening, the tabs are rotated to face one another so as to provide a compact profile. After the tabs pass through the faucet opening, the screws rotate the tabs so that they can be clamped against the underside of the sink. However, with such a design, the tabs can be difficult to rotate into position, and the screws tend to bend, such that the connection between the faucet and the sink can tend to loosen over time.

Thus, there remains a need for improvement in this field.

SUMMARY OF THE INVENTION

One aspect of the present invention concerns an apparatus that includes a trim member. The trim member defines a faucet receptacle constructed and arranged to receive a faucet hub. The trim member has an alignment tab constructed and arranged to align the faucet hub with the trim member. At least a pair of screws are coupled to the trim member. A foot member is threadedly secured to the screws, and the foot member is U-shaped with a pair screw engagement portions connected together by a deck engagement portion. The screw engagement portions each have a threaded screw opening in which one of the screws is threadedly secured to clamp a deck between the trim member and the foot member. The deck engagement portion has surface texturing to engage the foot member to the deck. The foot member is sized smaller than a faucet opening in the deck to slide through the faucet opening in the deck during installation.

Another aspect concerns an apparatus that includes a deck. The deck has a top side, a bottom side and a faucet opening extending from the top side to the bottom side of the deck. A trim member covers the faucet opening at the top side of the deck, and the trim member defines a faucet receptacle. A faucet hub is received in the faucet receptacle, and The faucet hub has a mounting shank extending through the faucet opening. The trim member and the faucet hub have an alignment structure to align the faucet hub with the trim member. An attachment member is coupled to the trim member and extends through the faucet opening. A foot member is coupled to the attachment and engages the bottom side of the deck. The foot member is sized to slide through the faucet opening from the top side to the bottom side during installation. The attachment member clamps the deck between the trim member and the foot member. A mounting bracket is slidably received on the mounting shank, and the mounting bracket defines a foot cavity in which the foot member is received. A fastening means is coupled to the mounting shank to clamp the mounting bracket to the bottom side of the deck.

A further aspect concerns a faucet mounting method. The method includes inserting a foot of a faucet mounting assembly from a top side of a deck and through an opening in the deck. The faucet mounting assembly includes a trim member and one or more screws connecting the foot to the trim member. The deck has a bottom side that is-opposite from the top side. The trim member is oriented on the deck, and the deck is clamped between the trim member and the foot by tightening the screws. A faucet is coupled to the trim member, and the faucet includes a mounting shank. The faucet is secured to the deck by attaching the mounting bracket to a mounting shank and tightening mounting bracket against the bottom side of the deck.

Further forms, objects, features, aspects, benefits, advantages, and embodiments of the present invention will become apparent from a detailed description and drawings provided herewith.

DESCRIPTION OF SELECTED EMBODIMENTS

Figure 1:
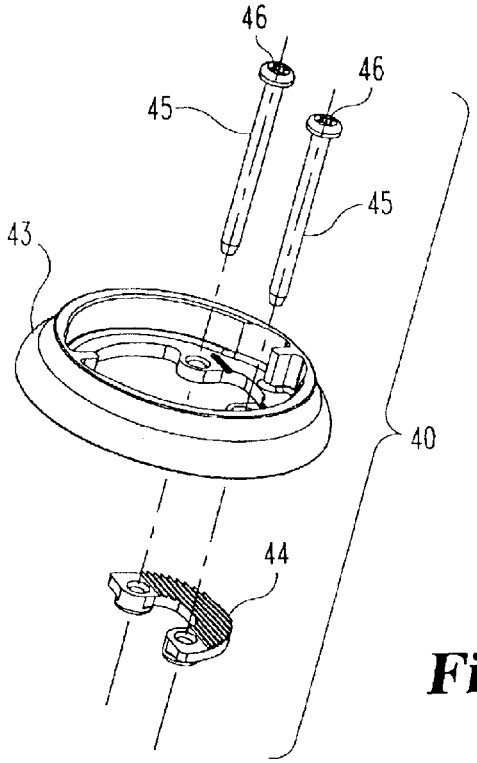
FIG. 1 is an exploded view of a faucet mounting system according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. One embodiment of the invention is shown in great detail, although it will be apparent to those skilled in the art that some of the features which are not relevant to the invention may not be shown for the sake of clarity.

A faucet mounting system 40 according to one embodiment, among others, of the present invention is illustrated in FIGS. 1–4. As will be appreciated from the discussion below, the faucet mounting system 40 according to the present invention allows the orientation of a faucet to be locked into position from above the sink and/or countertop. With reference to FIG. 1, system 40 includes a trim member 43, a foot member 44 and one or more screws (attachment members) 45 that secure the trim member 43 to the foot 44. Each screw 45 has a head 46 that engages the trim member 43, and by which the screw 45 is rotated. In the illustrated embodiment, the mounting system 40 includes a pair of screws 45 in order to provide positional stability for the foot 44. However, it should be appreciated that in other embodiments the system 40 can include more or less screws 45 than are shown. Moreover, in other embodiments, it is contemplated that other types of attachment means, besides screws, can be used to secure the trim member 43 to the foot 44.

Figure 2:
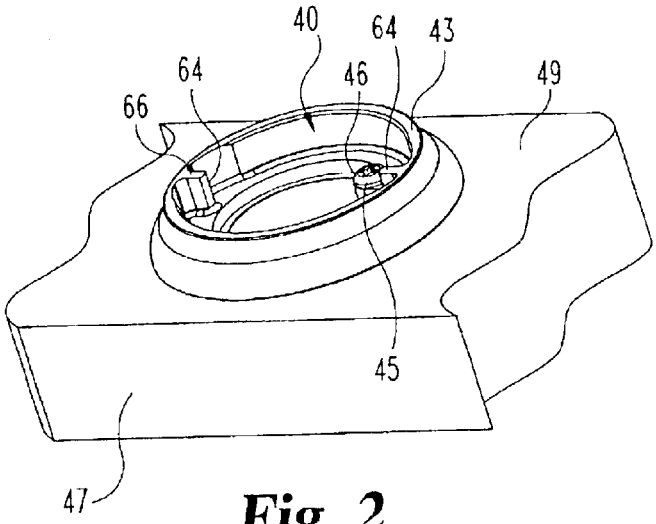
FIG. 2 is a top perspective view of the FIG. 1 faucet mounting system mounted to a mounting deck.
Figure 3:
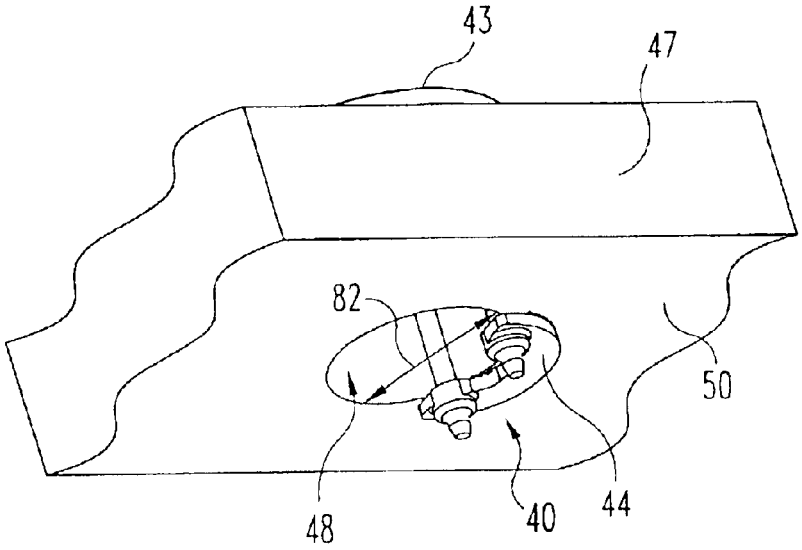
FIG. 3 is a bottom perspective view of the FIG. 1 system mounted to the mounting deck.
Figure 4:
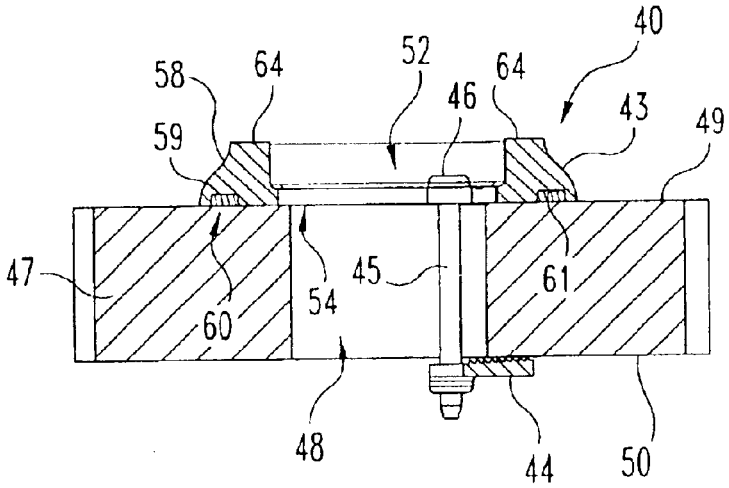
FIG. 4 is a side-elevational, cross-sectional view, in full section, of the FIG. 1 system mounted to the mounting deck.

As illustrated in FIGS. 2–4, the foot 44 and the screws 45 are used to secure the trim member 43 to a mounting deck 47. The screws 45 allow the system 40 to compensate for decks 47 of varying thicknesses. The mounting deck 47 defines a faucet opening 48 through which the screws 45 extend. In the illustrated embodiment, the faucet opening 48 has a cylindrical shape, but it should be appreciated that the faucet opening can be differently shaped. In one embodiment, the faucet opening 48 is a preformed opening in a sink through which water supply hoses are connected to the faucet. Referring to FIG. 4, the deck 47 has an upper or top side 49 on which the trim member 43 is secured and a lower or bottom side 50 against which the foot 44 is clamped. The mounting deck 47 can include any type of mounting surface or support structure that is used to support a faucet. By way of nonlimiting examples, the mounting deck 47 can include a sink and/or a countertop, to name a few. For instance, when the mounting deck 47 is in the form of a sink, the upper side 49 is the normally visible top surface of the sink and the lower side 50 is the underside of the sink. Likewise, when in the form of a countertop, the upper side 49 of the deck 47 is the working surface of the countertop and the lower side 50 is the underside of the countertop. Although the illustrated deck 47 is generally flat, it is contemplated that the deck 47 can be shaped differently, by being curved and/or by including surface contouring, for example. Even though the illustrated embodiment will be described with reference to a center mount style faucet, it should be appreciated that the faucet mounting system 40 according to the present invention can be configured for use with other types of mounting styles. For instance, the system 40 can be used with a deck mounting style faucet in which the trim member 43 has an oval shaped base plate configured to cover three faucet holes in the sink.

Figure 5:
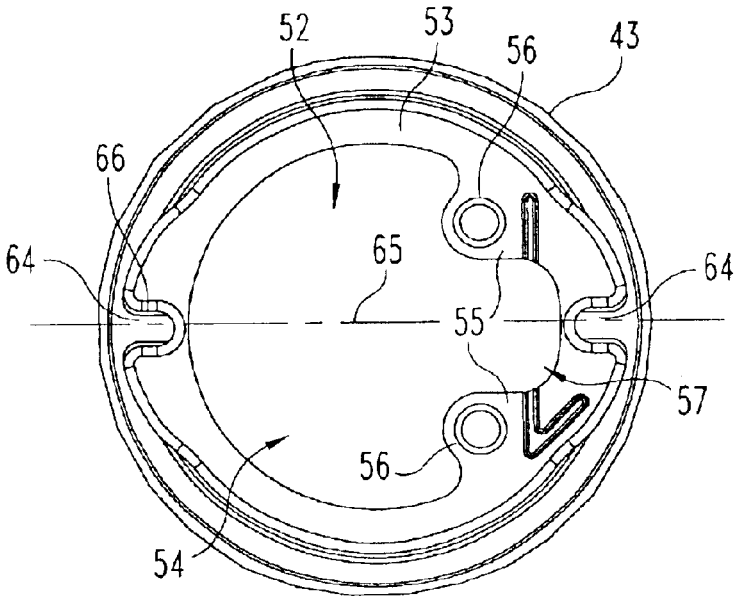
FIG. 5 is a top plan view of a trim member used in the FIG. 1 system.
Figure 6:
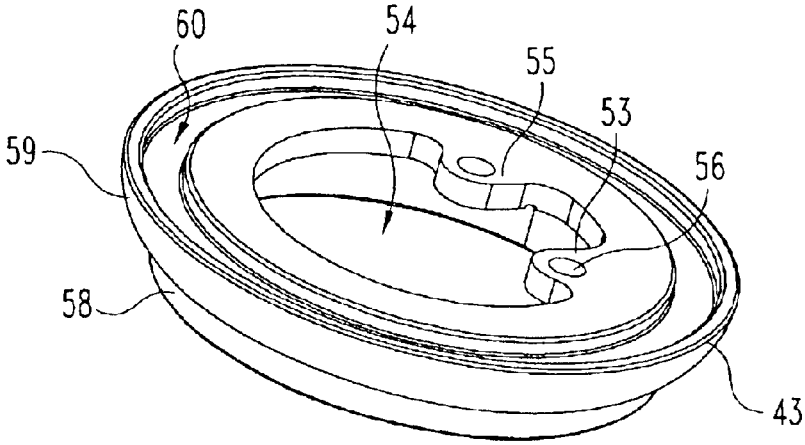
FIG. 6 is a perspective view of the FIG. 5 trim member.

As illustrated in FIGS. 4–6, the trim member 43 is generally ring shaped. As should be appreciated, however, the trim member 43 can have a different overall shape, such as an oval shape, for example. At least a portion of the trim member 43 is sized larger than the faucet opening 48 so that the trim member 43 is able to engage the upper side 49 of the deck 47. The trim member 43 defines a faucet cavity or receptacle 52 in which the faucet is received. In the faucet receptacle 52, the trim member 43 has a faucet support flange 53. The faucet support flange 53 defines a hose cavity 54 through which hoses from the faucet extend. Screw support tabs 55 extend from the faucet support flange 53 into the hose cavity 54. As shown in FIG. 5, the screw support tabs 55 engage the heads 46 of the screws 45 and define screw openings 56 in which the screws 45 are secured. Between the screw support tabs 55, the hose cavity 54 has a hose extension notch 57, which is configured to receive an outlet tube from the faucet. In the illustrated embodiment, the hose extension notch 57 gives the hose cavity 54 a general mushroom shape.

Figure 18:
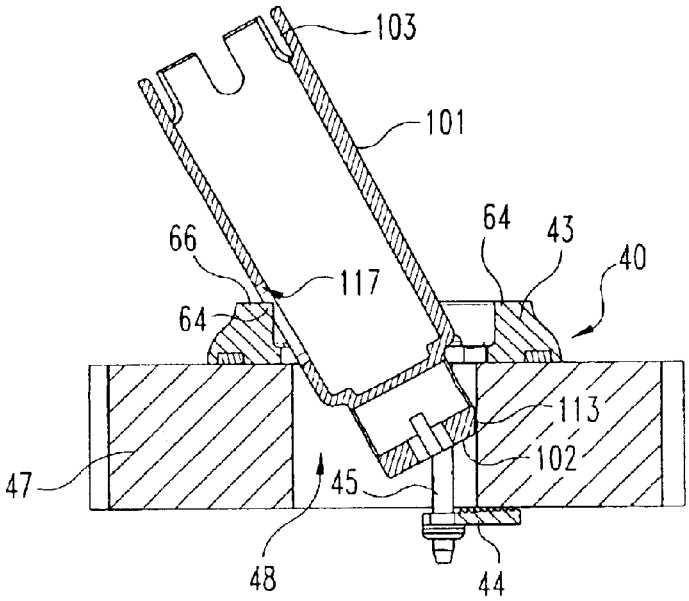
FIG. 18 is a side elevational, cross-sectional view, in full section, of the FIG. 11 tool during mounting of the FIG. 1 system.

As depicted in FIG. 4, the trim member 43 includes a hub engagement portion 58 in which the faucet receptacle 52 is defined and a deck engagement portion 59 at which the trim member 43 engages the deck 47. In the illustrated embodiment, the deck engagement portion 59 is wider than the hub engagement portion 58, and both portions 58 and 59 are curved. As shown, the deck engagement portion 59 has a convex shape, whereas the hub engagement portion 58 has a concave shape. The deck engagement portion 59 defines a gasket cavity 60 in which a gasket 61 is received in order to seal the faucet opening 48. In order to align the faucet in the faucet receptacle, the hub engagement portion 58 has hub alignment tabs 64 positioned on opposite sides of the faucet receptacle 52. As will be described in greater detail below with reference to FIG. 18, the alignment tabs 64 can also aid in aligning the screws 45 during installation. In FIG. 5, the hub alignment tabs 64 face one another and extend along an alignment tab axis 65 that is positioned between the screw support tabs 55. Relative to the alignment tab axis 65, the alignment tabs 64 in the illustrated embodiment are positioned approximately halfway between the screw support tabs 55. One of the alignment tabs 64 is socket engaging tab 66 that is positioned on the side of the trim member 43 that is opposite from the screw openings 56. The socket engaging tab 66 secures a socket to the trim member, during installation, so that the alignment of the screws 45 is maintained (FIG. 18).

Figure 7:
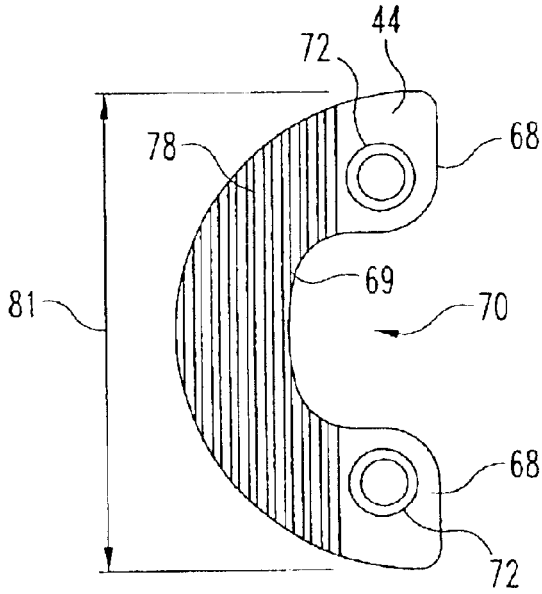
FIG. 7 is a top plan view of a foot member used in the FIG. 1 system.
Figure 8:
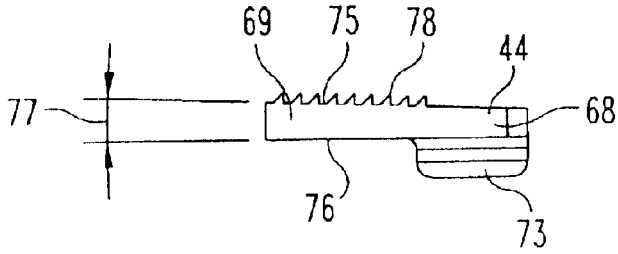
FIG. 8 is a side elevational view of the FIG. 7 foot.

Referring to FIGS. 7–8, the foot 44 in the illustrated embodiment is U-shaped. As shown, the foot 44 includes a pair of screw engagement portions 68 that are connected together through a deck engagement portion 69. Together, portions 68 and 69 define a hose channel 70 through which an outlet tube from the faucet extends. Each screw engagement portion 68 defines a screw engagement opening 72 in which the screws 45 are secured, and in the illustrated embodiment, the screw engagement openings 72 are threaded so as to engage the threads on the screws 45. The distance between the screw engagement openings 72 generally corresponds to the distance between the screw openings 56 in the trim member 43. By connecting the screws 45 together through the U-shaped foot 44, bending of the screws 45 is minimized when the foot 44 is clamped to the deck 47. As illustrated in FIG. 8, the screw engagement portion 68 includes a screw support extension 73 that provides additional support for the screws 45 once secured in the screw engagement openings 72. The added thickness provided by extensions 73 minimize rocking of the screws 45 in the openings 72, thereby ensuring that the foot 44 is firmly clamped against the deck 47.

The foot 44 has a first or deck engagement surface 75 that is constructed to engage the lower side 50 of the deck 47 and an opposite second surface 76 that faces away from the deck 47. As depicted in FIG. 8, the deck engagement surface 75 is angled with respect to surface 76 such that the foot 44 becomes thicker from the screw engagement portions 68 to the deck engagement portion 69 so as to improve engagement with the deck 47. In the illustrated embodiment, angle 77 between surfaces 75 and 76 is approximately two degrees. It should be appreciated, however, that this angle 77 can be different in other embodiments. To further aid in securing the foot 44 to the deck 47, the deck engagement surface 75 at the deck engagement portion 69 has ridges 78. In other embodiments, the deck engagement surface 75 can include other types of surface roughening or knurling in order to improve the fastening between the foot 44 and the deck 47. As measured from the outer peripheral edges of the screw engagement portions 68, the foot 44 has a width 81 that is less than or equal to width 82 of the faucet opening 48 (FIG. 3). In one form, the width 82 of the faucet opening 48 is 1.5 inches, and the width 81 of the foot 44 is less than 1.5 inches. The above-described construction allows the foot 44 to slide through the opening 48 in the deck 47, while at the same time it provides a large engagement area when the foot 44 is clamped to the deck 47.

Figure 10:
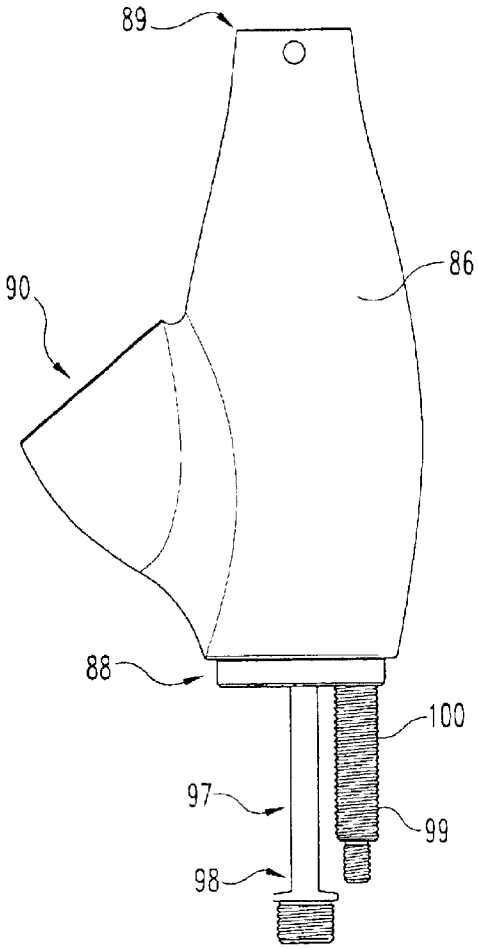
FIG. 10 is a front elevational view of the FIG. 9 faucet hub with fluid supply and outlet hoses.
Figure 9:
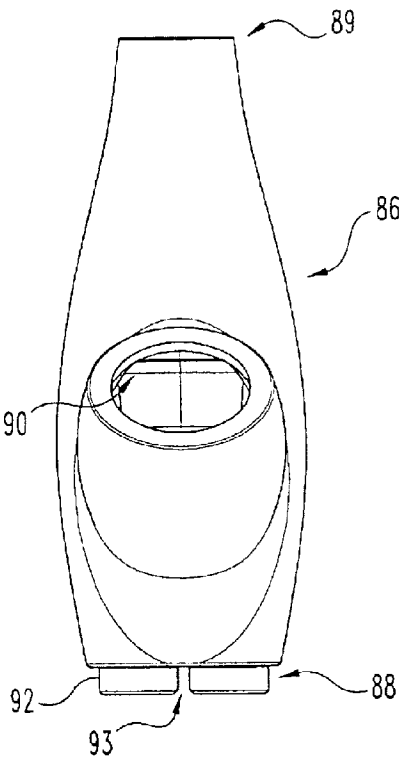
FIG. 9 is a side elevational view of a faucet hub that is mounted with the FIG. 1 system.

FIGS. 9–10 illustrate a faucet hub or housing 86 that can be mounted with the faucet mounting system 40 according to the present invention. It should be appreciated that other types of faucet hubs 86, in addition to the one illustrated, can be mounted using the faucet mounting system 40. As shown, the hub 86 includes a mounting end portion 88 at which the hub 86 is mounted on the mounting system 40 and a spout engagement end portion 89 at which a faucet spout is attached to the hub 86. Between the mounting end portion 88 and the spout engagement end portion 89, the hub 86 has a valve control lever mounting portion 90 to which a handle or lever that controls the fluid flow from the faucet. The mounting end portion 88 has a mounting flange 92 that is sized to be received in the faucet receptacle 52 defined in the trim member 43. In the illustrated embodiment, the mounting flange 92 has an overall cylindrical shape in order to coincide the shape of the faucet receptacle 52, but it is contemplated that flange 92 can be differently shaped in other embodiments. In order to align the hub 86 in the trim member 43, the mounting flange 92 defines a pair of alignment notches on opposite sides so as to coincide with the position of the alignment tab 64 of the trim member 43. The alignment notches 93 in the mounting flange 92 are sized to receive the alignment tab 64 so as to align the hub 86 with the trim member 43.

Referring to FIG. 10, the faucet hub 86 includes a valve assembly 97 that controls the flow of water from the faucet hub 86. The valve assembly 97 includes supply hoses or tubes 98 in which water is supplied to the faucet hub 86 and a valve outlet tube or shank 99 in which water is discharged from the valve assembly 97. As shown, the valve outlet tube 99 has threading 100 for securing the hub 86 to the deck 47. In one embodiment, a spray hose, which is threaded through the hub 86 and attached to a wand or the like, can be attached to the valve outlet tube 99. Within the valve assembly 97, the water from the supply tubes 98 can be mixed and the result of that mixture is discharged via valve outlet tube 99. For example, in one embodiment, the supply tubes 98 include a pair of hot and cold water supply hoses, and the outlet tube 99 supplies hot water, cold water or a mixture of both to a spray head via a spray hose.

Figure 11:
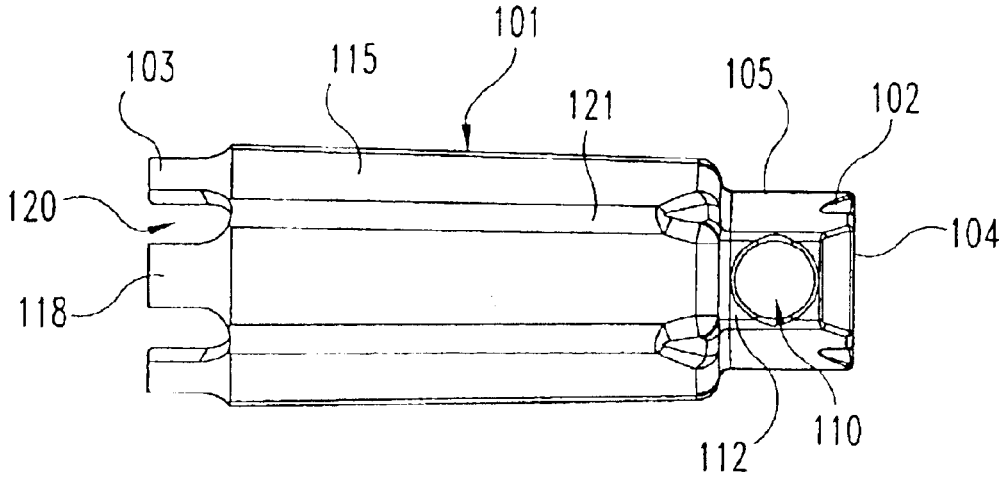
FIG. 11 is a front elevational view of a mounting tool according to one embodiment of the present invention.
Figure 12:
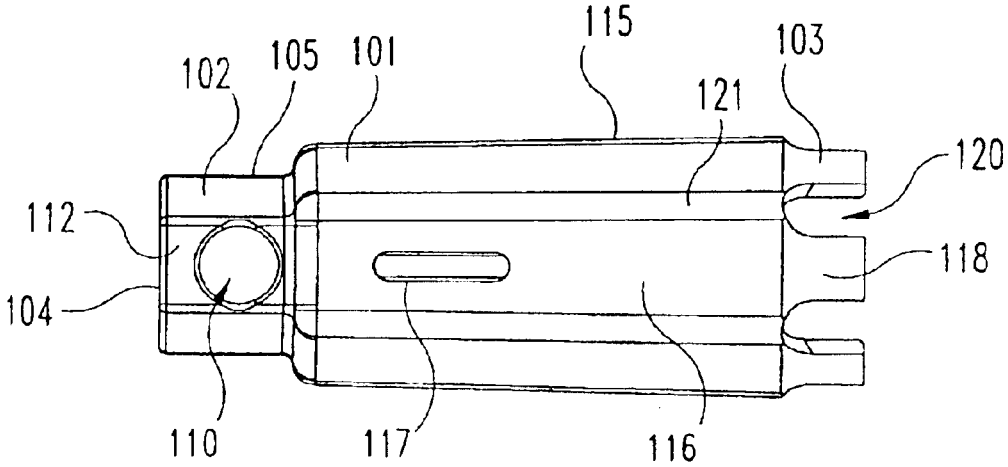
FIG. 12 is a rear elevational view of the FIG. 11 tool.
Figure 13:
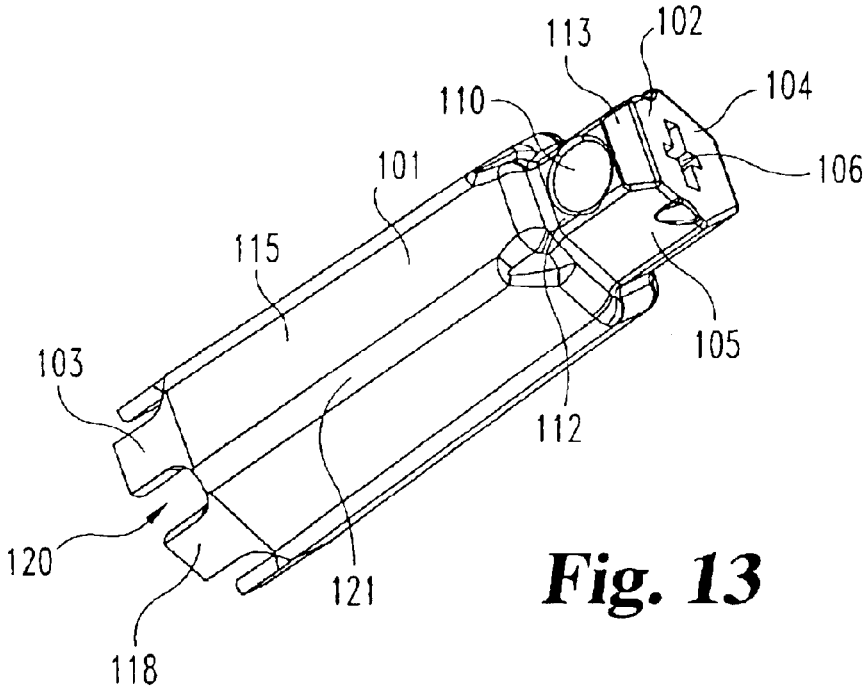
FIG. 13 is a perspective view of the FIG. 11 tool.
Figure 14:
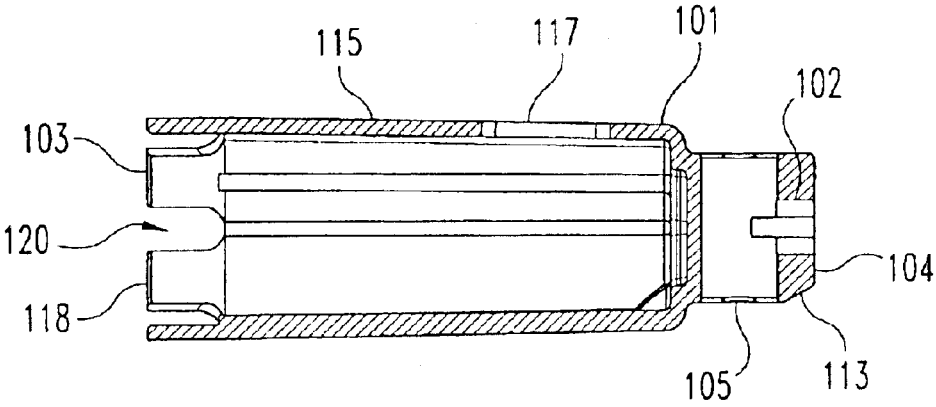
FIG. 14 is a side elevational, cross-sectional view, in full section, of the FIG. 11 tool.

FIGS. 11–13 illustrate a socket 101 according to one embodiment of the present invention that is used to mount the hub 86 to the deck 47. As shown, the socket 101 includes a tool engagement end portion 102 by which the socket 101 is rotated and a nut engagement end portion 103 in which a nut for securing the faucet hub 86 is received. The tool engagement end portion 102 is configured to attach to a tool that is used to rotate the socket 101. The tool engagement end portion 102 includes an end wall or surface 104 that is surrounded by side walls 105. As illustrated in FIG. 13, the end wall 104 of the tool engagement end portion 102 defines a tool engagement opening 106 in which a tool, such as a screwdriver is secured. In the illustrated embodiment, the tool engagement opening 106 is in the shape of a cross so as to allow engagement with both standard and Phillips head screwdrivers. Furthermore, the tool engagement end portion 102 in the illustrated embodiment has a general hexagonal shape such that end 102 can also be received in a socket wrench for rotating the socket 101. A pair of the side walls 105 define a shaft opening 110 through which a shaft of a tool, such as the shaft of a screwdriver, can be inserted in order to turn the socket 101. One of the side walls 105, side wall 112, has a faucet hole engagement wall 113 that extends at an angle between the side wall 112 and the end wall 104 to form a beveled surface. As will be discussed in detail below, the faucet hole engagement wall 113 is angled in order to engage the faucet opening 100 when the socket 101 is used to keep the screws 45 aligned during installation (see, FIG. 18).

Between the tool engagement end portion 102 and the nut engagement end portion 103, the socket 101 has a body 115, which in the illustrated embodiment has a hexagonal cross-sectional shape. The body 115 has body walls 116 that give the body 115 the overall hexagonal shape. It should be appreciated, however, that the socket 101 can have a different overall shape. On the side opposite from the faucet hole engagement wall 113, one of the body walls 116 defines a tab engagement slot or opening 117 that is used to position the socket 101 when the screws 45 are tightened, as is shown in FIGS. 12 and 18. The tab engagement slot 117 is sized to receive and secure the socket 101 to one of the alignment tabs 64. At the nut engagement end portion 103, the socket 101 has finger extensions 118 that are configured to engage a nut. In the illustrated embodiment, the fingers 118 have an overall hexagonal pattern so as to correspond to the shape of a hexagonal shaped nut, but in other embodiments, the fingers 118 can have other overall patterns depending on the shape of the nut used. Between each finger 118, the socket 101 defines corner gaps 120. The corner gaps 120 are configured to received the corners of a nut. As should be appreciated, the corner gaps 120 reduce the overall size of the socket 101 so that the socket 101 can be rotated in tight spaces, such as those that exist underneath the sink during installation of the faucet hub 86. Between each of the body walls 116, the socket 101 has beveled edges 121 that are aligned with the corner gaps 120 so as to further minimize the rotational profile of the socket 101.

Figure 15:
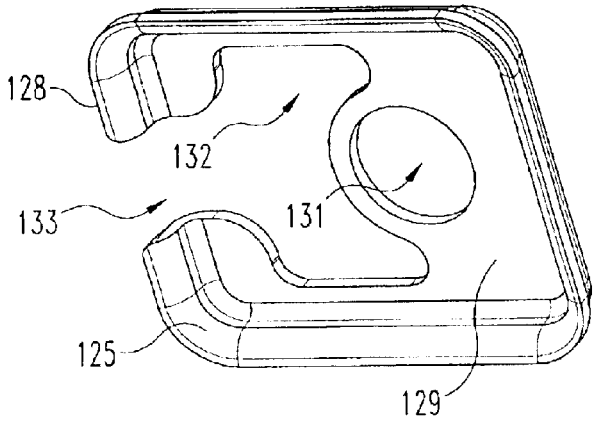
FIG. 15 is a perspective view of the mounting bracket used in conjunction with the FIG. 1 system.
Figure 16:
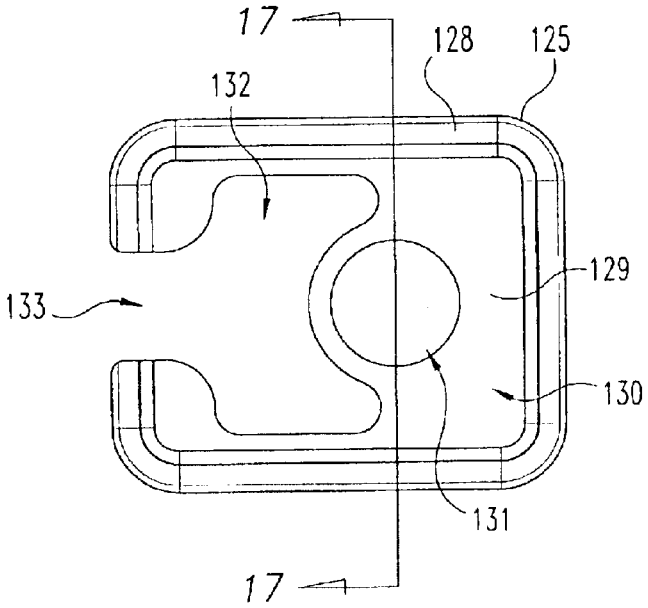
FIG. 16 is a top plan view of the FIG. 15 bracket.
Figure 17:
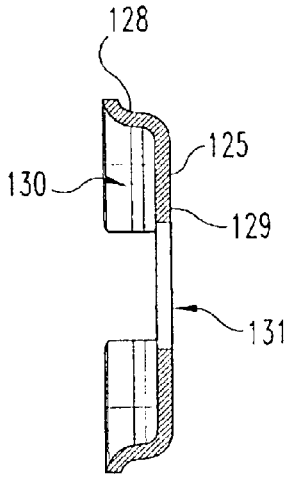
FIG. 17 is a side elevational, cross-sectional view, in full section, of the FIG. 15 bracket as taken along line 17—17 in FIG. 16.

The socket 101 is used to secure a mounting bracket 125, which is illustrated in FIGS. 15–17, to the outlet tube 99 of the faucet hub 86 in order to firmly secure the hub 86 to the deck 47. In one embodiment, the mounting bracket 125 is larger than the size of the faucet opening 48. As shown, the mounting bracket 125 has a peripheral flange 125 that extends from a base 129 and defines a foot cavity 130 in which the foot 44 is received, when the faucet hub 86 is mounted. The base 129 defines an outlet tube cavity 131 through which the outlet tube 99 extends once the mounting bracket 125 is installed. In the illustrated embodiment, the outlet tube cavity 131 has a generally circular shape so as to coincide with the shape of the outlet tube 99. However, it should be appreciated that opening 131 can be shaped differently. The base 129 further defines a supply tube cavity 132 that is configured to receive the supply tube 98. In the illustrated embodiment, the supply tube cavity 132 is to some extent U-shaped in order to receive the supply tubes 98. In particular, the supply tube cavity 132 has a tube opening 133 defined in the peripheral flange 128 in order to aid in the insertion of the supply hoses 98 into the supply tube cavity 132.

A technique for installing a faucet with the faucet mounting system 40 according to the present invention will now be described with reference to FIGS. 1–4, 18, and 19. The technique and faucet mounting structure described below unites the convenience of top side (above the sink) faucet mounting systems with the mounting strength provided by the underside faucet mounting systems. As previously mentioned, the faucet mounting system 40 allows the faucet hub 86 to be oriented and secured into position from above the deck 47, thereby preventing accidental rotation of the faucet hub 86 during underside faucet fastening. As noted above, the strength of the connection provided by pure top side faucet mounting designs tend to weaken over time. Therefore, after the mounting system 40 has been oriented and locked into position from the upper side 49 of the deck 47, the faucet hub 86 is firmly secured with the mounting bracket 125 to the deck 47 from the lower side 50 of the deck 47.

Initially, the faucet mounting system 40 is assembled by inserting the screws 45 through the screw openings 56 defined in the trim member 43, and the screws 45 are threadedly engaged with the screw engagement openings 72 defined in the foot 44. Once system 40 is assembled, the foot 44 is inserted through the faucet opening 48 from the upper side 49 of the deck 47. The mounting system 40 is then slid so that the deck engagement portion 69 of the foot 44 engages the lower side 50 of the deck 47. In one embodiment, the system 40 is slid until the screws 45 hit the wall of the faucet opening 48 so as to firmly seat the mounting system 49 in the faucet opening 48. The trim member 43 is positioned to cover the faucet opening 48 and rotated so that the faucet hub 86 is properly aligned. Optionally, the hub 86 can be inserted into the faucet receptacle 52 in the trim member 43 so that the position of the faucet hub 86 can be visualized as the mounting system 40 is moved. As soon as the trim member 43 is positioned at the correct orientation, the tool engagement end portion 102 of the socket 101 is inserted at an angle into the faucet opening 48 so that the socket 101 extends between the screws 45. As shown in FIG. 18, the tab engagement slot 117 is positioned to engage the socket engagement tab 64 in the trim member 43 that is located opposite from the screws 45. The faucet hole engagement wall 113 of the socket 101 engages the wall of the faucet opening 48. By positioning the socket 101 between the screws 45, the screws 45 can be tightened without becoming misaligned. As the screws 45 are tightened (via their heads 46), the foot 44 as well as the trim member 43 clamps the deck 47 in between, thereby securing the faucet mounting system 40 to the deck 47. Once the faucet mounting system 40 is firmly secured to the deck 47, the socket 101 can be removed from the trim member 43.

After the mounting system 40 is secured, the faucet hub 86 can be positioned in the faucet receptacle 52 defined in the trim member 43. As previously mentioned, the hub 86 is oriented in the receptacle 52 by the alignment tabs 64. To orient the faucet hub 86, the alignment tabs 64 are mated with the alignment notches 93 defined in the mounting flange 92 of the faucet hub 86. The alignment tabs 64 further assist in positioning the outlet tube 99 into the hose extension notch 57 in the trim member 43. In a similar fashion, the supply tubes 98 extend through the hose cavity 54 in the trim member 43. From the upper side 49 of the deck 47, the installer is able to secure and visually inspect the position of the faucet hub 86. If necessary, the faucet hub 86 can be removed and the screws 45 loosened so that the trim member 43 can be repositioned and secured in the manner as described above so that the faucet hub 86 is aligned properly.

Figure 19:
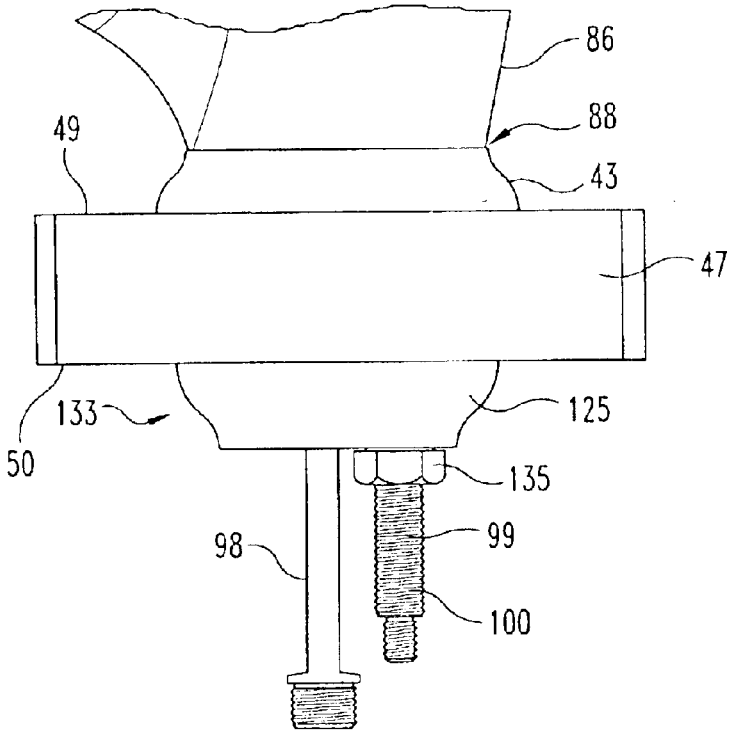
FIG. 19 is a side elevational view of a faucet mounted with the FIG. 1 system.

As illustrated in FIG. 19, once the faucet hub 86 is properly positioned and the mounting system 40 is secured to the deck 47, the mounting bracket 125 can then be secured to the mounting deck 47 from lower side 50 of the deck 47. While the installer secures the mounting bracket 125 from the lower side 50 of the deck, the mounting system 40 maintains the faucet hub 86 in the proper orientation. The outlet tube cavity 131 of the mounting bracket 125 is slid around the outlet tube 99 of the faucet hub 86. The supply tubes 98 are positioned in the supply tube cavity 132 of the mounting bracket 125. The socket 101 is then used to tighten a fastening means or nut 135 onto the threading 100 of the valve outlet tube 99. If the deck 47 is relatively thin, a spacer in the form of a collar can be slid onto the outlet tube 99 between the nut 135 and the bracket 125. As previously mentioned, due to the smaller rotational profile of the socket 101 that is provided by the corner gaps 120, the socket 101 can be used in the tight space between the supply tubes 98 and the outlet tube 99. The nut 135 is further tightened until the faucet hub 86 is firmly secured to the deck 47. When the mounting bracket 125 is secured against the deck 47, the foot 44 is located inside the foot cavity 130 in the mounting bracket 125. After the faucet hub 86 is mounted, other components, such as water supply lines, can be connected to the faucet. As should be appreciated, the faucet mounting system 40 and mounting technique according to the present invention eliminates the need for having to repeatedly orient and secure the faucet hub 86 to the deck 47 while securing the faucet underneath the deck 47. Moreover, the faucet mounting technique according to the present invention makes it easier for one person to securely mount the faucet.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A faucet system, comprising:

a trim member defining a faucet receptacle constructed and arranged to receive a faucet hub, said trim member having an alignment tab constructed and arranged to align the faucet hub with said trim member;

at least a pair of screws coupled to said trim member; and a foot member threadedly secured to said screws, said foot member being u-shaped with a pair of screw engagement portions connected together by a deck engagement portion, said screw engagement portions each having a threaded screw opening in which one of said screws is threadedly secured to clamp a deck between said trim member and said foot member, said deck engagement portion having surface texturing to engage said foot member to the deck, said foot member being sized smaller than a faucet opening in the deck to slide through the faucet opening in the deck during installation.

2. The system of claim 1, wherein said screw engagement portions each have screw extension portions extending therefrom for providing additional support for the screws.

3. The system of claim 1, wherein said surface texturing on said deck engagement portion of said foot member includes ridges.

4. The system of claim 1, wherein said trim member is ring shaped.

5. The system of claim 1, wherein said foot member is thicker at said deck engagement portion to improve clamping against said deck.

6. The system of claim 1, further comprising the faucet hub received in said faucet receptacle.

7. The system of claim 6, wherein the faucet hub has an alignment notch engaged with said alignment tab.

8. The system of claim 6, further comprising:

wherein the faucet hub includes a mounting shank;

a mounting bracket having a shank opening in which said mounting shank is received; and a nut securing said mounting bracket to said mounting shank for securing the faucet hub to the deck.

9. The system of claim 1, further comprising a socket with an alignment slot engaged with said alignment tab and having an end portion positioned between said screws to maintain alignment of said screws during clamping of said trim member and said foot member to the deck.

10. The system of claim 1, wherein said socket has extension fingers extending therefrom, said extension fingers defining nut corner gaps that are constructed and arranged to receive corners of a nut.

11. The system of claim 1, further comprising:

wherein said screw engagement portions each have screw extension portions extending therefrom for providing additional support for the screws;

wherein said surface texturing on said deck engagement portion of said foot member includes ridges;

wherein said trim member is ring shaped;

wherein said foot member is thicker at said deck engagement portion to improve clamping against said deck;

the faucet hub received in the faucet receptacle, the faucet hub having an alignment notch engaged with said alignment tab, the faucet hub including a mounting shank;

a mounting bracket having a shank opening in which said mounting shank is received; and a nut securing said mounting bracket to said mounting shank for securing the faucet hub to the deck.

12. A faucet system, comprising:

a deck having a top side, a bottom side and a faucet opening extending from said top side to said bottom side of said deck;

a trim member covering said faucet opening at said top side of said deck, said trim member being sized larger than said faucet opening, said trim member defining a faucet receptacle for receiving a faucet hub;

at least two attachment members coupled to said trim member and extending through said faucet opening;

a foot member coupled to each of said attachment members to minimize bending of said attachment members during installation, said foot member engaging said bottom side of said deck, said foot member being sized to slide through said faucet opening from said top side to said bottom side during installation;

wherein said attachment members are engageable from said top side of said deck to clamp said deck between said trim member and said foot member from said top side of said deck; and wherein said foot member is u-shaped and defines a hose channel through which a tube from a faucet hub is able to extend.

13. The system of claim 12, wherein said trim member includes an alignment structure to align said faucet hub with said trim member.

14. The system of claim 13, wherein said alignment structure includes an alignment tab extending within said faucet receptacle.

15. The system of claim 12, wherein said trim member includes at two support tabs where said attachment members are coupled to said trim member, said support tabs defining a hose notch through which said tube from said faucet hub is able to extend.

16. The system of claim 12, wherein said attachment members include screws.

17. The system of claim 12, wherein said trim member defines a hose cavity through which a hose of said faucet hub extends.

18. The system of claim 12, further comprising a gasket positioned between said trim member and said deck to seal said faucet opening.

19. The system of claim 12, wherein said foot member includes support extension minimize rocking of said attachment members.

* * * * *